US009601002B2

(12) United States Patent
Blum et al.

(10) Patent No.: US 9,601,002 B2
(45) **Date of Patent: *Mar. 21, 2017**

(54) SYSTEM AND METHOD FOR PROTECTING A SECURITY SYSTEM

(71) Applicants: William R. Blum, Huntington Station, NY (US); Raymond J. Jordan, Holtsville, NY (US); Catherine C. Sottile-Ramos, Blue Point, NY (US)

(72) Inventors: William R. Blum, Huntington Station, NY (US); Raymond J. Jordan, Holtsville, NY (US); Catherine C. Sottile-Ramos, Blue Point, NY (US)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 42 days.

This patent is subject to a terminal disclaimer.

(21) Appl. No.: 14/586,042

(22) Filed: Dec. 30, 2014

(65) Prior Publication Data

US 2015/0137969 A1 May 21, 2015

Related U.S. Application Data

(63) Continuation of application No. 13/221,943, filed on Aug. 31, 2011, now Pat. No. 8,952,803.

(51) Int. Cl.

| | |
|---|---|
| ***G08B 29/02*** | (2006.01) |
| ***G08B 25/00*** | (2006.01) |
| ***G08B 25/14*** | (2006.01) |

(52) U.S. Cl.
CPC ..... *G08B 29/02* (2013.01); *G08B 25/001* (2013.01); *G08B 25/14* (2013.01)

(58) Field of Classification Search
CPC ..... G08B 25/001; G08B 25/14; G08B 25/08; G08B 25/10; G08B 29/06; G05B 23/02
USPC .. 340/506, 507, 500, 501, 286.02, 635, 518, 340/606; 73/101, 195; 374/1
See application file for complete search history.

(56) References Cited

U.S. PATENT DOCUMENTS

| | | | | |
|---|---|---|---|---|
| 4,481,503 | A | 11/1984 | Lehman et al. | |
| 7,170,998 | B2 | 1/2007 | McLintock et al. | |
| 7,403,109 | B2 | 7/2008 | Martin | |
| 2002/0099945 | A1 | 7/2002 | McLintock et al. | |
| 2002/0154009 | A1* | 10/2002 | McCuen et al. | 340/501 |
| 2006/0250231 | A1* | 11/2006 | Wang | G08B 29/18 340/507 |
| 2008/0079561 | A1 | 4/2008 | Trundle et al. | |
| 2008/0191861 | A1 | 8/2008 | Mason et al. | |

* cited by examiner

*Primary Examiner* — Sisay Yacob
(74) *Attorney, Agent, or Firm* — Husch Blackwell LLP

(57) ABSTRACT

A regional security system includes a control panel that can receive one or more delay parameters associated with a type of sensor or detector or a portion of a region being monitored. The delay parameters can be stored in a programmable storage unit. When an alarm indicator has been received from one of the sensors or detectors, an alarm indicating message and an associated programmed and pre-stored delay can be forwarded to a central station. If the system is disarmed before the delay interval has terminated, then a cancel message can be sent to the central station.

20 Claims, 3 Drawing Sheets

SYSTEM AND METHOD FOR PROTECTING A SECURITY SYSTEM

This application is a continuation of U.S. patent application Ser. No. 13/221,943 filed on Aug. 31, 2011 and now U.S. Pat. No. 8,952,803 issued on Feb. 10, 2015, which is incorporated herein by reference.

FIELD

The application pertains to regional security or monitoring systems. More particularly, the application pertains to such systems that include circuitry to provide a level of security for self-contained monitoring systems.

BACKGROUND

Regional monitoring or security systems can be used in residential buildings to provide alarm indicating signals either locally or to a displaced central station. Known alarms usually include a control panel with at least one display unit and keypad for use in controlling the system. In known alarm systems there is a delay associated with Exit/Entry and Security Industry Association (SIA) required dialer delays. During this time, alarms are held by the panel. If a burglar locates and destroys the panel before one of the above times expire, then the alarm will not be sent and the system will be defeated.

To solve the above problem, the alarm is generated when the zone is violated. It is sent as a special "delayed reporting" alarm type and includes a fixed delay time for the zone that was violated. Known implementations use a fixed delay, which is usually set to a worst case value.

The alarm is then sent via either the Internet or a wireless communicator to an alarm receiver or an alarm transport service. The alarm is held by either the alarm transport service or the alarm receiver for the duration of the delay specified in the message plus an additional guard time to account for network transport times. Once this time runs out, it is considered a real alarm.

If sent via the alarm transport service, then the alarm is forwarded to the central station. If sent to the receiver, then the receiver releases the alarm to an automation system. If the system is disarmed before the delay has expired, then a cancel message is sent to either the alarm transport service or the receiver, which will cancel the delivery of the delayed alarm.

DETAILED DESCRIPTION

Figure 1:
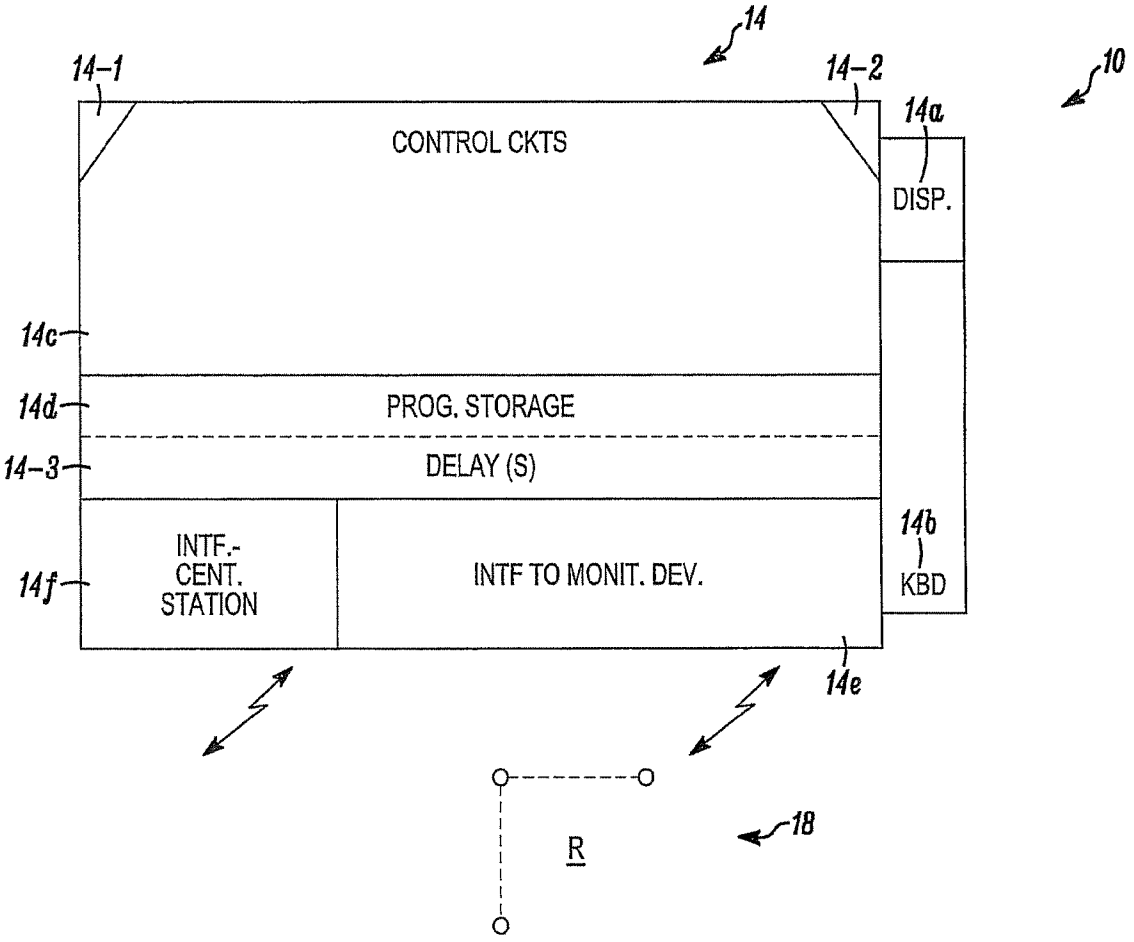
FIG. 1 is a block diagram of portions of an embodiment hereof.

While disclosed embodiments can take many different forms, specific embodiments hereof are shown in the drawings and will be described herein in detail with the understanding that the present disclosure is to be considered as an exemplification of the principles hereof as well as the best mode of practicing the same and is not intended to limit the claims hereof to the specific embodiment illustrated.

In a disclosed embodiment, the delay is variable and can be based on how the panel was programmed. By making the delay variable, security and response time can be improved on a custom basis from installation to installation. In yet another aspect, different delays could be set for different types of sensors or detectors. Alternately, different delays could be associated with different rooms or parts of a region being monitored.

FIG. 1 illustrates aspects of a system 10 in accordance herewith that monitors on-going conditions in a region R. The system 10 includes a control panel 14 located in the region R and readily accessible therein. The panel 14 is coupled wired, wirelessly, or both to a plurality of detectors or sensors 18 in the region R. Members of the plurality 18 can include glass break detectors, motion detectors, door detectors, smoke or fire detectors, thermal detectors, or gas detectors, all without limitation.

The panel 14 can carry a local display 14*a*, a keypad 14*b*, and control circuits 14*c* coupled to the display 14*a* and the keypad 14*b*. The control circuits 14*c* can be implemented, at least in part, by one or more programmable processors 14-1 and associated executable control programs or software 14-2. The programs or software 14-2 can be stored in various types of memory units such as read-only, programmable read-only or read-write memory units.

Programmable storage 14*d* can also be coupled to the control circuits 14*c*. The programmable storage 14*d* can include storage for delay intervals 14-3, wherein one or more delay intervals can be stored. Such intervals can be entered locally via the keypad 14*b*, via an interface 14*e* that couples the panel 14 to members of the plurality 18, or via a wired or wireless interface 14*f* through which the panel 14 can communicate with displaced elements, including a central station, discussed subsequently.

Figure 2:
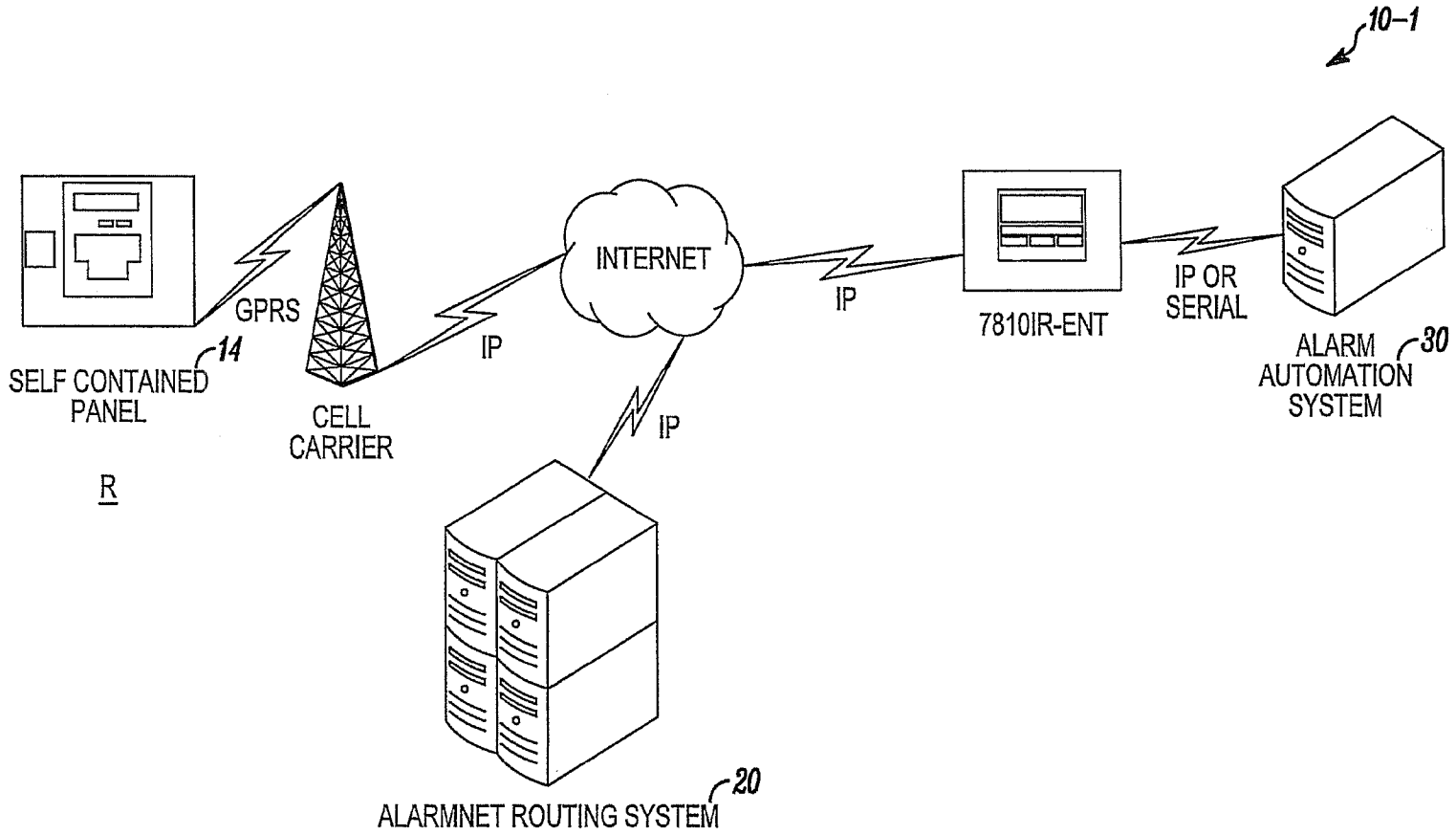
FIG. 2 is a block diagram with additional details as to an embodiment hereof.

FIG. 2 illustrates the panel 14 monitoring the region R as discussed above relative to FIG. 1 in the context of a communications system 10-1 that couples the panel 14 to a routing system 20 that communicates with a central station 30. Those of skill will understand that a variety of communications implementations come within the scope and spirit hereof. Those details are not limitations of the present exemplary embodiments.

Operationally, when the panel 14 is armed and indicates that a zone is exhibiting a pre-alarm, an alarm, or an intrusion of a delayed reporting type, for example, an exit/entry or dialer delay, the panel 14 can transmit an appropriate message to the routing system 20 and/or the central station 30. This message can include information as to the triggering condition, an associated delay setting for that particular alarm, an incremental margin value, and an indication that this is a delayed alarm. The time of the alarm and the type of the delay could also be transmitted.

This message then traverses the network and is received at the routing system 20 where it is placed in a wait state with the delay duration. An acknowledgement message or symbol can be returned to the panel 14.

A retry timer can be set to the delay setting without the margin value. If prior to the timeout of the retry timer, the system 20 and the panel 14 are still in communication and the panel 14 is disarmed, then a cancelation message will be sent from the panel indicating that it is an alarm cancel request. At that time, the system 20 can cancel delivery of the delayed alarm.

However, if the panel 14 has been destroyed or the message represents a real alarm, then no further traffic will be received from the panel 14, and the routing system 20 forwards notice of an alarm to the central station 30. If a normal check in is not received from the panel 14 indicating it is still functional, then a communication failure can be indicated for that installation.

Figure 3:
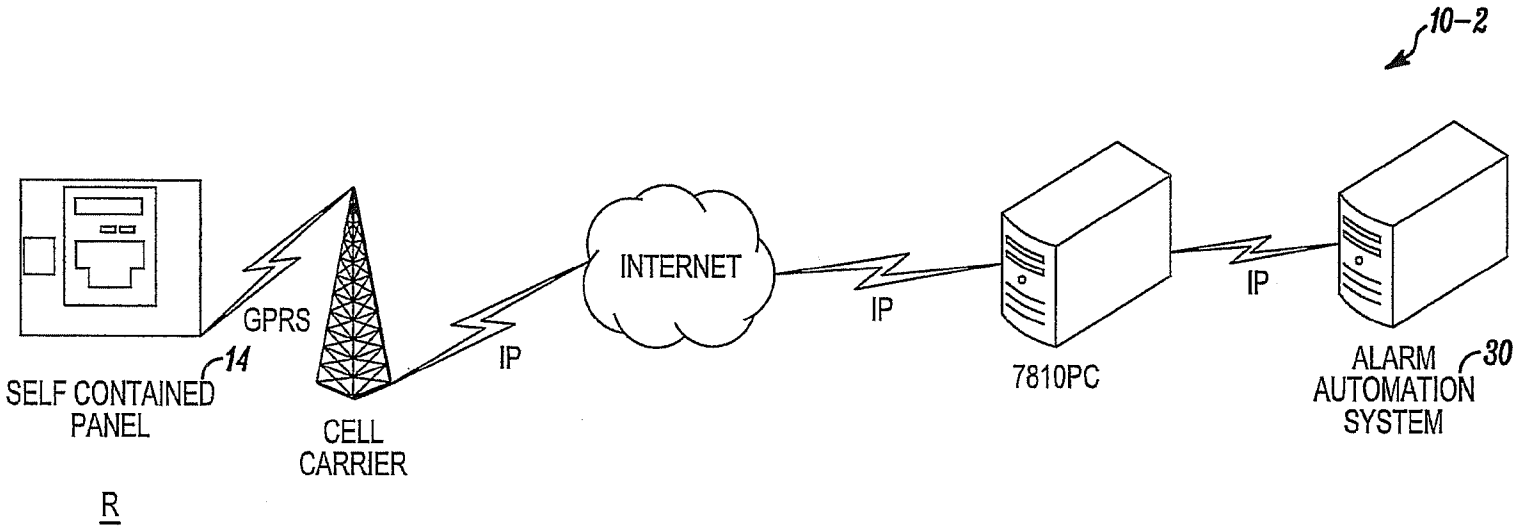
FIG. 3 is a block diagram with additional details of an alternate embodiment.

FIG. 3 illustrates a variation 10-2 of the system 10-1 of FIG. 2. As illustrated in FIG. 3, the panel 14 can communicate with the alarm automation system 30 via a variety of communications protocols and networks, including cellular-type communications protocols and systems or internet protocols and computer based communications networks. In the presence of a delayed-type alarm condition, the panel 14 sends a message to the 7810PC.

The message can include information as to the cause of the alarm condition, a delay interval setting for that particular alarm, a margin interval, and an acknowledge code indicating a delayed alarm. The message can be stored at the 7810PC for the duration of the interval. An acknowledge code can be returned to the panel 14. A retry timer at the 7810PC can be set to the delay interval received from the panel 14.

In the event of a normal disarm, if, prior to the time out of the retry timer, the 7810PC is still communicating with the panel 14 and the panel 14 becomes disarmed, then the delayed alarm message can be resent from the panel 14 with an alarm cancel code. Receipt of this message at the 7810PC will result in the delayed alarm indicator message being deleted at the 7810PC. The system will continue on in an unalarmed state.

If the panel 14 is destroyed or not disarmed, then it is possible that no further communications will be received from the panel 14. In this instance, the 7810PC will forward the alarm message to the alarm automation system 30 and the central monitoring station. Alternately, if the panel 14 has not been destroyed or damaged, then it can send an all-is-well message with an indicator that a normal test alarm message had previously been forwarded.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

Further, logic flows depicted in the figures do not require the particular order shown or sequential order to achieve desirable results. Other steps may be provided, steps may be eliminated from the described flows, and other components may be added to or removed from the described embodiments.

The invention claimed is:

1. A monitoring method comprising:

coupling a plurality of regional monitoring sensors and detectors to control circuits and providing variable delay circuitry; and communicating between the control circuits and interface circuits and, responsive to an alarm indicator from a member of the plurality of regional monitoring sensors and detectors, transmitting an alarm indicating message via the interface circuits, the alarm indicating message specifying a respective pre-set delay interval established by the variable delay circuitry and including information as to a cause of the alarm indicator, wherein the variable delay circuity determines a duration for the respective pre-set delay interval based on the member of the plurality of regional monitoring sensors and detectors that triggered the alarm indicator.

2. The method as in claim 1 further comprising providing programmable storage in the variable delay circuitry.

3. The method as in claim 1 further comprising establishing at least one of different pre-set delay intervals for different members of the plurality of regional monitoring sensors and detectors or different portions of a region being monitored.

4. The method as in claim 2 further comprising responding to at least one of a manually entered delay or a wirelessly received delay and, responsive thereto, storing an indicator of the manually entered delay or the wirelessly received delay in the programmable storage.

5. The method as in claim 4 further comprising responding to a system disarm indicator and, responsive thereto, transmitting a cancel message via the interface circuits.

6. The method as in claim 5 further comprising providing at least one of wired or wireless communications.

7. The method as in claim 3 further comprising providing programmable storage.

8. The method as in claim 7 further comprising responding to a plurality of manually entered delays and storing indicators of each of the plurality of manually entered delays in the programmable storage.

9. The method as in claim 8 further comprising locally displaying the respective pre-set delay interval.

10. The method as in claim 6 further comprising providing one or more of glass break detectors, door sensors, motion sensors, fire detectors, or gas detectors; and providing locations for storage of the respective pre-set delay interval associated with respective members of the plurality of regional monitoring sensors and detectors.

11. The method as in claim 1 further comprising:

providing programmable storage; and including one or more of glass break detectors, door sensors, motion sensors, fire detectors, or gas detectors, wherein the programmable storage includes locations for storage of the respective pre-set delay interval associated with respective members of the plurality of regional monitoring sensors and detectors.

12. A monitoring process comprising:

providing a plurality of sensors or detectors;

providing a control panel including a display device, a manually operable input unit and control circuits;

providing variable delay circuitry;

responding to a selected indicator from a member of the plurality of sensors or detectors by transmitting an alarm indicating message via an interface, wherein the alarm indicating message specifies a pre-set delay interval established by the variable delay circuitry and information as to a cause of the alarm indicating message; and providing and storing at least one programmable delay parameter, wherein the variable delay circuity determines a duration for the pre-set delay interval based on the member of the plurality of sensors or detectors that triggered the selected indicator.

13. The process as in claim 12 further comprising receiving an alarm indicator and, responsive thereto, forwarding the alarm indicating message, message and the at least one programmable delay parameter associated therewith to a displaced location.

14. The process as in claim 12 wherein, responsive to detecting that the control panel has been disarmed before the pre-set delay interval has terminated, transmitting a cancel message to a displaced location.

15. A system comprising:

a plurality of sensors and detectors configured to generate an alarm indicator; and a local alarm monitoring panel in communication with each of the plurality of sensors and detectors that establishes a programmable delay interval by at least one of downloading or manually entering the programmable delay interval into a selected electronic location of the local alarm monitoring panel, and wherein the local alarm monitoring panel forms a first message that includes at least an alarm type indicium of an alarm, information as to a cause of the alarm, and a representation of the programmable delay interval in response to receiving the alarm indicator and transmits the first message to a displaced location, and wherein the local alarm monitoring panel determines a duration for the programmable delay interval based on which member of the plurality of sensors and detectors generated the alarm indicator.

16. The system as in claim 15 further comprising circuits that receive and analyze the first message and, responsive thereto, place the alarm indicator into a wait state.

17. The system as in claim 16 further comprising additional circuitry to set a retry delay.

18. The system as in claim 17 wherein the additional circuitry responds to a second message and determines if the second message is an alarm cancel message.

19. The system as in claim 18 wherein the additional circuitry, responsive to determining if the second message is the alarm cancel message, cancels the alarm indicator.

20. The system as in claim 18 wherein the additional circuity, responsive to expiration of the retry delay and in an absence of the alarm cancel message, determines if the alarm should be initiated.

* * * * *